US005946535A

United States Patent [19]

Aoki

[11] Patent Number: 5,946,535

[45] Date of Patent: Aug. 31, 1999

[54] MAGNET ROLLER AND DEVELOPING ROLLER USING THE SAME

[75] Inventor: Shigeru Aoki, Yokohama, Japan

[73] Assignee: Bridgestone Corporation, Tokyo, Japan

[21] Appl. No.: 09/136,297

[22] Filed: Aug. 19, 1998

[30] Foreign Application Priority Data

Aug. 21, 1997 [JP] Japan ..... 9-240388

[51] Int. Cl.[6] ..... G03G 15/09

[52] U.S. Cl. ..... 399/277; 492/8; 492/18

[58] Field of Search ..... 399/277, 267–271, 399/279; 492/8, 53, 18

[56] References Cited

U.S. PATENT DOCUMENTS 5,554,479 9/1996 Ochiai et al. ..... 430/122
5,842,962 12/1998 Yamada et al. ..... 492/18

OTHER PUBLICATIONS

English Abstract of Japanese Document JP 63030875A, Feb. 1988.

English Abstract of Japanese Document JP 08202133A, Aug. 1996.

*Primary Examiner*—Richard Moses
*Attorney, Agent, or Firm*—Sughrue, Mion, Zinn, Macpeak & Seas, PLLC

[57] ABSTRACT

Disclosed is a highly noiseless magnet roller capable of reducing occurrence of noise upon operation as much as possible. The magnet roller includes a magnet main body and a shaft portion projecting from each or either of both ends of the magnet main body, wherein the magnet main body and the shaft portion are integrally molded from a bond magnet composition in which a magnetic powder is dispersed in a resin binder. In this magnet roller, the roundness of the shaft portion is specified to be in a range of 30 $\mu$m or less.

4 Claims, 2 Drawing Sheets

MAGNET ROLLER AND DEVELOPING ROLLER USING THE SAME

BACKGROUND OF THE INVENTION

The present invention relates to a magnet roller adopted for a developing roller which is used, in an electrophotographic apparatus or an electrostatic recording apparatus such as a copying machine or a printer, for supplying a developer to an image forming body holding an electrostatic latent image, for example, a photosensitive drum, a belt, or a sheet of paper, OHP or photographic paper and forming a visible image on the surface of the image forming body, and also relates to a developing roller composed of the magnet roller and a sleeve. In particular, the present invention relates to a magnet roller composed of a magnet main body and shaft portions formed integrally with the magnet main body wherein the magnet roller is high in roundness of each shaft portion and is thereby rendered highly noiseless upon operation, and also relates to a highly noiseless developing roller using the above magnet roller.

Conventionally, for an electrophotographic apparatus or an electrostatic recording apparatus such as a copying machine or a printer, there has been adopted a developing method using, as a developing roller for visualizing an electrostatic latent image on a latent image holding body such as a photosensitive drum, a magnet roller which is formed from a bond magnet and is disposed in a rotating sleeve. In this method, a magnetic developer (toner) supported on the surface of the sleeve is supplied on the surface of the latent image holding body by a so-called jumping phenomenon allowing the toner to be jumped on the latent image holding body by a magnetic force characteristic of the magnet roller, to thereby visualize the electrostatic latent image.

The above magnet roller has been conventionally manufactured by a manner of mixing a magnet powder made from ferrite or the like with a binder composed of a thermoplastic resin such as nylon or polypropylene to prepare pellets of a bond magnet composition, and injecting-molding or extrusion-molding these pellets of the bond magnet composition using a die applied with a magnetic field, to thereby form the bond magnet composition into a roller shape and also magnetize the bond magnet composition with a specific magnetic characteristic. In this case, shaft portions for supporting the magnet roller have been generally provided at both ends of the magnet roller, and to reduce the manufacturing cost and enhance the magnetic force, there has been proposed a method in which each or either of both the shaft portions and the magnet main body have been integrally molded from a bond magnet composition.

The magnet roller of the type in which the magnet main body and each or either of the shaft portions are integrally molded from a bond magnet composition, however, has a problem that noise is liable to occur upon developing operation. In particular, for a developing roller of a type in which not only the sleeve but also the magnet roller is rotated, there is a tendency that noise significantly occurs.

To be more specific, there is known a developing roller of a type shown in FIG. 1, in which two shaft portions 12 of a magnet roller 1 are rotatably supported by two bearings 3 mounted in a sleeve 2 rotatably disposed so that the magnet roller 1 is rotatably disposed in the sleeve 2, wherein developing operation is performed by rotating the magnet roller 1 in the direction reversed to the rotational direction of the sleeve 2. In this case, if the magnet roller 1 of the developing roller is composed of a magnet main body 11 formed integrally with the shaft portions 12, there occurs noise upon operation, and particularly, for a developing roller of a type in which the above shaft integral type magnet roller 1 is rotated at a high speed of 150 rpm or more, there significantly occurs noise.

SUMMARY OF THE INVENTION

In view of the foregoing, the present invention has been made, and an object of the present invention is to provide a highly noiseless magnet roller capable of reducing occurrence of noise as much as possible even if the magnet roller is used for a developing roller of a type of rotating the magnet roller, particularly, rotating the magnet roller at a high speed, and to provide a highly noiseless developing roller using the above magnet roller.

The present inventor has earnestly studied the magnet roller to achieve the above object, and found that the cause of noise occurring in the case where a magnet roller including a magnet main body and shaft portions integrally formed from a bond magnet composition is used for a developing roller of a type rotating the magnet roller is due to the roundness of each shaft portion of the magnet roller, and that a highly noiseless shaft integral type magnet roller can be obtained by improving the roundness of each shaft portion up to such a level as to prevent occurrence of noise.

To be more specific, the shaft integral type magnet roller is molded, generally, using a die having a split structure. In this case, a so-called parting line is formed on the roller at a portion corresponding to the parting plane of the die. Thus, as shown in FIG. 3A, a parting line PL extending in the axial direction appears on the outer peripheral surface of the shaft portion 12, which reduces the roundness of the shaft portion 12. Further, as shown in FIG. 3B, a escape "h" for escaping burrs is formed in the shaft portion 12 along the length direction (axial direction) for preventing occurrence of burrs from the parting line. The escape "h" further reduces the roundness of the shaft portion 12. As a result of the examination of the present inventor, it was revealed that the sleeve 2 of the developing roller having the structure shown in FIG. 1 is applied with a load (100 gf or more) uniform along the longitudinal direction by a magnetic action (attractive force with magnetic toner or magnetic blade) at the developing mechanism portion, and when in such a state the magnet roller 1 having the shaft portions 12 being low in roundness (not round) is rotated at a high speed, there occurs vibration at the shaft portions 12, thereby causing noise upon operation. The present inventor has further studied the magnet roller and found that even if a magnet roller rotated at a high speed, occurrence of noise can be reduced as much as possible by setting the roundness of each shaft portion in a range of 30 $\mu$m or less, particularly, 20 $\mu$m or less, whereby a magnet roller highly noiseless upon operation can be obtained. The present invention has been accomplished on the basis of the above knowledge.

According to a first aspect of the present invention, there is provided a magnet roller including a magnet main body and a shaft portion projecting from each or either of both ends of the magnet main body wherein the magnet main body and the shaft portion are integrally molded from a bond magnet composition in which a magnetic powder is dispersed in a resin binder, characterized in that the roundness of the shaft portion is in a range of 30 $\mu$m or less.

According to a second aspect of the present invention, there is provided a developing roller including: a cylindrical sleeve rotatably disposed and a magnet roller rotatably disposed in the sleeve wherein a developer is supported on the outer peripheral surface of the sleeve by a magnetic characteristic of the magnet roller to form a thin layer of the developer, the developing roller is moved close to an image forming body, and the developer is jumped and supplied on the surface of the image forming body by the magnetic characteristic of the magnet roller, to form a visible image on the surface of the image forming body, characterized in that the magnet roller is that described in the first aspect of the present invention.

According to the magnet roller of the present invention, even when used for a developing roller of a type rotating a magnetic roller, particularly, a developing roller of a type of rotating a magnet roller at a high speed, the magnet roller can be rendered highly noiseless by reducing occurrence of noise as much as possible. As a result, a developing roller of the present invention using the magnet roller can be rendered highly noiseless upon developing operation by effectively preventing occurrence of noise upon operation.

BRIEF DESCRIPTION OF THE DRAWINGS

Other features and advantages of the present invention will be apparent from the following description taken in conjunction with the accompanying drawings in which.

DETAILED DESCRIPTION OF THE PREFERRED EMBODIMENTS

Hereinafter, the present invention will be described in detail with reference to the accompanying drawings.

Figure 1:
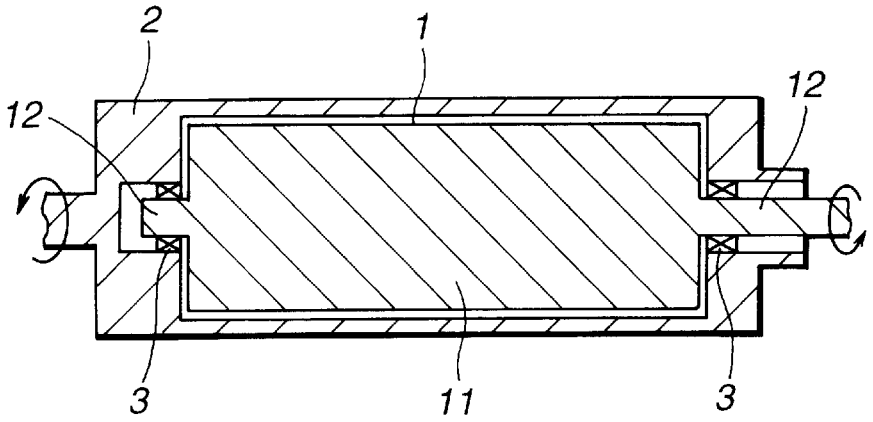
FIG. 1 is a schematic sectional view showing one example of a developing roller using a magnet roller of the present invention.

Like the magnet roller 1 shown in FIG. 1, a magnet roller 1 of the present invention includes a magnet roller main body 11 and two shaft portions 12, wherein the magnet roller main body 11 and the shaft portions 12 are integrally formed from a bond magnet composition. In the present invention, the roundness of each shaft portion 12 is specified in a range of 30 μm or less.

Figure 2:
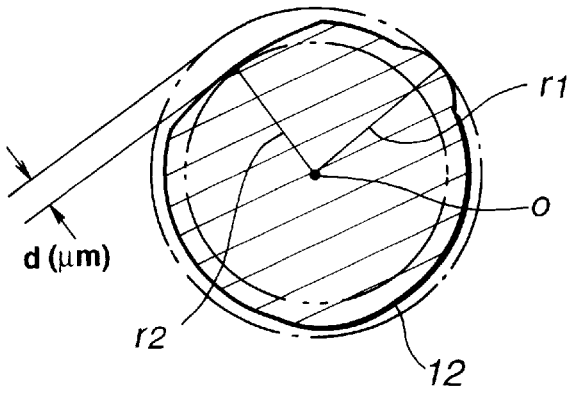
FIG. 2 is a view illustrating the roundness of a shaft portion according to the present invention.

The wording "roundness" used in the present invention means a difference d(unit: μm) between the maximum radius r1 and the minimum radius r2 from the center "o" in the cross-sectional shape of the shaft portion 12, as shown in FIG. 2. According to the present invention, the roundness is specified to be in a range of 30 μm or less, preferably, 20 μm or less.

Figure 5:
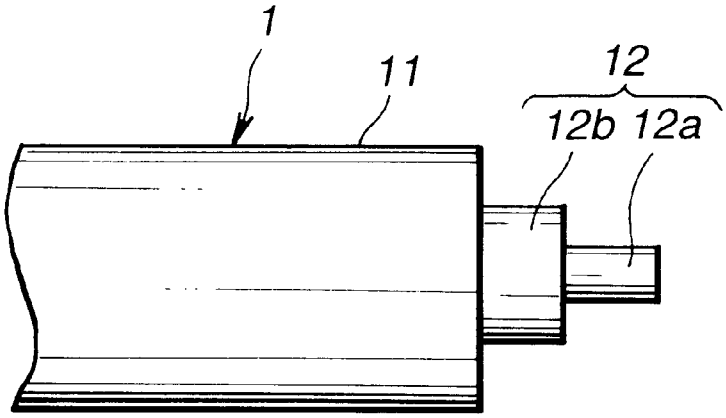
FIG. 5 is a partial plan view showing one example of a shaft portion of the magnet roller of the present invention.

The shaft portion of the magnet roller of the present invention generally has a diameter uniform from the base end to the leading end, just as the shaft portion 12 shown in FIG. 1; however, as shown in FIG. 5, the shaft portion 12 may be composed of a base end portion 12*b* having a slightly larger diameter and a leading end portion 12*a* having a small diameter. In this case, of the shaft portion 12, a portion required to have the above roundness is that supported by the sleeve 2 via the bearing 3 in FIG. 1. For example, if the base end portion 12*b* of the shaft portion 12 in FIG. 5 is supported by the bearing 3 in FIG. 1, the base end portion 12*b* is set to have the roundness of 30 μm or less, and if the leading end portion 12*a* is supported by the bearing 3 in FIG. 1, the leading portion 12*a* is set to have the roundness of 30 μm or less. In addition, even for the shaft portion 12 having a constant diameter as shown in FIG. 1, the shaft portion 12 is not required to have the roundness of 30 μm or less over the entire length, but a portion of the shaft portion 12 supported by the bearing 3 may be set to have the roundness of 30 μm or less.

As described above, the magnet roller of the present invention includes the magnet main body 11 and the shaft portions 12 which are integrally molded from a bond magnet composition. In this case, the kind of the bond magnet composition is not particularly limited, but a known bond magnet composition in which a magnetic powder is dispersed in a resin binder can be used.

As the above resin binder, there may be used a polyamide resin such as nylon 6 or nylon 66; polystyrene resin; polyethylene terephthalate resin (PET); polybutylene terephthalate resin (PBT); polyphenylene sulfide resin (PPS); ethylene-vinyl acetate copolymer resin (EVA); ethylene-ethyl acrylate resin (EEA); epoxy resin; ethylene-vinyl alcohol copolymer resin (EVOH); polypropylene resin; polyolefin resin such as polyethylene resin or polyethylene copolymer resin; or denaturated polyolefin resin in which a functional group having a reactivity such as a maleic anhydride group, carboxyl group, hydroxyl group, or glycidyl group is introduced in the structure of the polyolefin. A mixture of one kind or two kinds or more of these resins can be used. In addition, of these resins, a polyamide resin, EVA or EEA is, while not exclusively, preferably used.

As the above magnet powder, there can be used a usual magnetic powder having been conventionally used for a magnet roller. Specific examples of the magnetic powders include a powder of ferrite such as Sr ferrite or Ba ferrite, and a powder of a rare earth based alloy such as a Sm-Co alloy, Nd-F-B alloy or Ce-Co alloy.

The content of the magnetic powder may be suitably selected depending on a necessary magnetic force and is generally, while not exclusively, preferred to be in a range of about 80 to 94 wt % on the basis of the total weight of the bond magnet composition (density: about 2.5 to 4.5 g/cm3).

The bond magnet composition containing the above binder and magnetic powder may be further added with a filler having a large reinforcing effect such as mica, whiskers, talc, carbon fibers, or glass fibers. In the case where the content of the above magnetic powder is small, the rigidity of the molded product is liable to be reduced. In such a case, the molded product can be reinforced by addition of a filler such as mica or whiskers. In particular, mica or whiskers may be suitably used in the present invention. As whiskers, there may be used non-oxide based whiskers made from silicon carbide or silicon nitride; metal oxide based whiskers made from ZnO, MgO, TiO2, SnO2, or Al2O3; or double oxide based whiskers made from potassium titanate, aluminum borate or basic magnesium sulfate. Of these whiskers, double oxide based whiskers are particularly suitably used in terms of easy mixing with plastic.

The content of the filler is not particularly limited but is generally, while not exclusively, set to be in a range of about 2 to 32 wt %, preferably, about 5 to 20 wt % on the basis of the total weight of the bond magnet composition. It is to be noted that the bond magnet composition may be further added with an additive other than the above filler without departing from the scope or spirit of the present invention.

The method of molding the magnet roller of the present invention using the above bond magnet composition is not particularly limited insofar as the magnet roller including shaft portions each having the roundness of 30 μm or less can be obtained; however, in general, an injection-molding process is preferably adopted to mold the magnet roller of the present invention. In this case, the method of forming the magnet roller including shaft portions each having the roundness of 30 μm or less by injection-molding is, while not exclusively, performed in the following procedure. A portion of a die for forming a shaft portion is taken as a core. The core is provided with a cavity for forming a shaft portion using a rotating tool (drilling tool or cutting tool). Also, the core is finely finished by electric discharge machining or wire cutting. Then, the core having a cavity for forming a shaft portion, which is excellent in roundness, is mounted to a die having a slide mechanism. By use of such a die, a magnet roller including a shaft portion having the roundness of 30 μm or less can be molded.

In the case of forming the magnet roller of the present invention by injection-molding, while not exclusively, the magnet roller is preferably formed by a method of mixing the above components of a bond magnet composition in accordance with a usual manner, hot-kneading the mixture, molding once the mixture into pellets to form a pellets of the molding material, and injection-molding such a molding material using the above die. In this case, the above hot-kneading may be performed by a usual process under usual conditions using a biaxial kneading extruder or KCK kneading extruder.

The conditions for injection-molding, that is, molding conditions such as a cylinder temperature, die temperature, and injection pressure may be set as usual depending on the size of a target magnet roller, physical properties of a bond magnet composition as a molding material, and the like.

Figure 4:
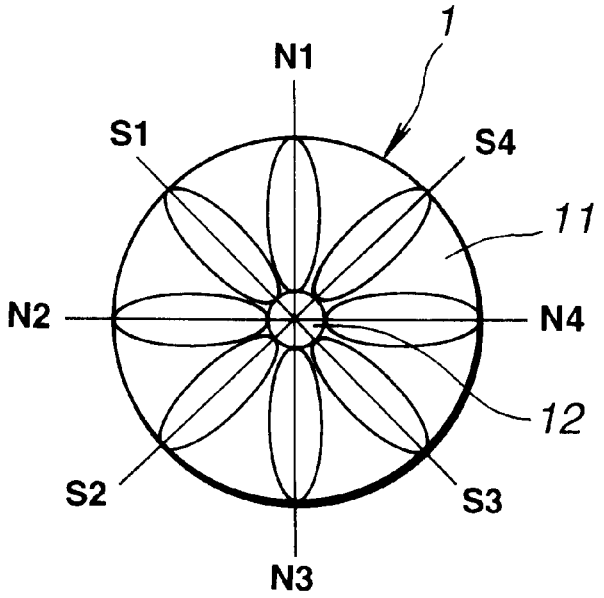
FIG. 4 is a schematic view showing one example of a pattern of magnetic force of the magnet roller of the present invention.

The magnet roller of the present invention can be imparted with a desired pattern of magnetic force by magnetizing the roller by a usual manner upon or after the above-described molding. In this case, while not exclusively, the magnet roller of the present invention is preferably imparted with a uniformly distributed pattern of magnetic force which exhibits a high noise reduction effect in the case where the magnet roller is used for a developing roller of a type including a highly rotating magnet roller. In addition, the uniformly distributed pattern of magnetic force means a pattern of magnetic force in which a plurality of magnetic poles having nearly equal peaks of magnetic force are arranged with nearly equal intervals in the peripheral direction of the roller, for example, a pattern of magnetic force shown in FIG. 4 in which four pieces of N-poles N1 to N4 and four pieces of S-poles S1 to S4, having nearly equal peaks of magnetic force, are arranged at nearly equal intervals along the peripheral direction of the roller 1 in such a manner that the N-poles and S-poles are alternated.

The developing roller of the present invention using the above magnet roller including shaft portions each having the roundness of 30 μm or less is, for example, configured as shown in FIG. 1 in which the developing roller includes a cylindrical sleeve 2 rotatably disposed and a magnet roller 1 rotatably disposed in the sleeve 2, wherein a developer is supported on the outer peripheral surface of the sleeve 2 by the magnetic characteristic of the magnet roller 1 to form a thin layer of the developer; the magnet roller 1 is moved close to an image forming body; and the developer is jumped and supplied on the surface of the image forming body by the magnetic characteristic of the magnet roller 1 to thus form a visible image on the surface of the image forming body, and wherein the above magnet roller of the present invention including the shaft portions each being excellent in roundness is used as the magnet roller 1.

According to the above developing roller using the magnet roller of the present invention as the magnet roller 1, in the case of the above developing operation with the sleeve 2 and the magnet roller 1 both rotated, the developing roller is rendered highly noiseless upon operation by reducing occurrence of noise as much as possible, and particularly, the effect becomes significantly large in the case where the magnet roller 1 is rotated at a high speed of 150 rpm or more.

The configuration of the above developing roller of the present invention is not limited to that shown in FIG. 1. For example, shapes of the sleeve 2 and the magnet roller 1 and connection between the sleeve 2 and the magnet roller 1 can be suitably changed, and further the other configurations may be variously changed within the scope or spirit of the present invention.

The present invention will be more fully described by way of, while not exclusively, inventive examples and comparative examples.

Inventive Examples 1 to 4

A bond magnet composition having the following composition was injection-molded in the following conditions. Four kinds of magnet rollers each including shaft portions each having a roundness shown in Table 1 were prepared using the above bond magnet composition. In addition, the dimensions of the magnet roller are as follows.

| | |
|---|---|
| Dimension of Magnet Roller | |
| magnet main body: 310 mm in length, 14 mm in outside diameter | |
| shaft portion: 6 mm in length, 6 mm in diameter | |
| Bond Magnet Composition | |
| binder: nylon 6 | 10 wt % |
| magnetic powder: Sr ferrite | 90 wt % |
| Condition of Injection-molding | |
| cylinder temperature: 290 to 300 Åé | |
| die temperature: 110 to 120 Åé | |
| injection pressure: 700 kg/cm$^2$ | |

Comparative Examples 1 and 2

Figure 3A:
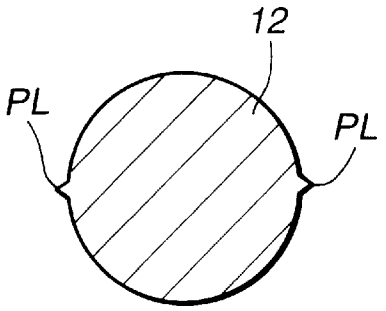
FIG. 3 is a schematic sectional view showing a shaft portion of a related art magnet roller.
Figure 3B:
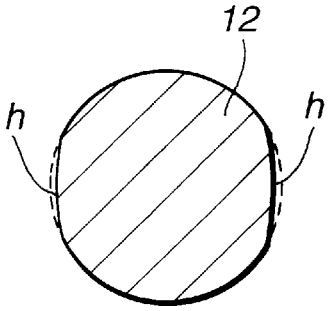

In Comparative Example 1, a magnet roller was prepared in the same manner as that in Inventive Example 1, except that the shaft portion 12 has a parting line PL and the roundness of the shaft portion 12 was 40 μm, as shown in FIG. 3A; and in Comparative Example 2, a magnet roller was prepared in the same manner as that in Inventive Example 1, except that the shaft portion 12 had a escape h for escaping burrs and the roundness of the shaft portion 12 was 50 μm, as shown in FIG. 3B.

A developing roller having the same configuration as that shown in FIG. 1 was prepared using each of the magnet rollers in Inventive Examples 1 to 4 and Comparative Examples 1 and 2. Such a developing roller was measured in terms of noise under a condition that the magnet roller 1 was rotated at 720 rpm and the sleeve 2 was reversely rotated at 60 rpm. The results are shown in Table 1. In addition, the measurement of noise was performed in accordance with JIS Z8731.

TABLE 1

| | Intensive Example | | | | Comparative Example | |
|---|---|---|---|---|---|---|
| | 1 | 2 | 3 | 4 | 1 | 2 |
| Roundness (μm) | 15 | 10 | 20 | 30 | 40 | 50 |
| Noise (dB) | 48.4 | 43.3 | 47.0 | 54.4 | 70.3 | 80 |

From the results shown in Table 1, it was confirmed that each of the magnet rollers in Inventive Examples 1 to 4 in which the roundness of the shaft portion is 30 μm or less is low in the degree of noise upon operation, and therefore, it is highly noiseless upon operation.

What is claimed is:

1. In a magnet roller comprising:

a magnet main body; and a shaft portion projecting from each or either of both ends of said magnet main body;

wherein said magnet main body and said shaft portion are integrally molded from a bond magnet composition in which a magnetic powder is dispersed in a resin binder;

the improvement wherein the roundness of said shaft portion is in a range of 30 μm or less.

2. A magnet roller according to claim 1, wherein a pattern of magnetic force of said magnet roller is a uniformly distributed pattern in which a plurality of magnetic poles having nearly equal magnetic force peaks are arranged with nearly equal intervals in the peripheral direction of said roller.

3. In a developing roller comprising:

a cylindrical sleeve rotatably disposed; and a magnet roller rotatably disposed in said sleeve;

wherein a developer is supported on the outer peripheral surface of said sleeve by a magnetic characteristic of said magnet roller to form a thin layer of said developer; said developing roller is moved close to an image forming body; and said developer is jumped and supplied on the surface of said image forming body by the magnetic characteristic of said magnet roller, to form a visible image on the surface of said image forming body;

the improvement wherein said magnet roller is that described in claim 1.

4. A developing roller according to claim 3, wherein said magnet roller is rotated at a high speed of 150 rpm or more.

* * * * *